US008181798B2

(12) United States Patent
Möller

(10) Patent No.: US 8,181,798 B2
(45) Date of Patent: May 22, 2012

(54) MOBILE OR STATIONARY WORKING APPARATUS WITH TELESCOPIC EXTENSION ARM ELEMENTS WHOSE POSITION IN RELATION TO ONE ANOTHER IS DETECTED BY RFID TECHNOLOGY

(75) Inventor: Ulrich Möller, Karlsruhe (DE)

(73) Assignee: PAT GmbH, Ettlingen (DE)

( * ) Notice: Subject to any disclaimer, the term of this patent is extended or adjusted under 35 U.S.C. 154(b) by 33 days.

(21) Appl. No.: 12/302,887

(22) PCT Filed: Feb. 2, 2007

(86) PCT No.: PCT/EP2007/000890

§ 371 (c)(1),
(2), (4) Date: Nov. 30, 2008

(87) PCT Pub. No.: WO2007/137634

PCT Pub. Date: Dec. 6, 2007

(65) Prior Publication Data

US 2009/0250424 A1 Oct. 8, 2009

(30) Foreign Application Priority Data

May 30, 2006 (DE) ..... 10 2006 025 002

(51) Int. Cl.
*B66C 13/18* (2006.01)

(52) U.S. Cl. ..... 212/276; 212/230; 212/271; 340/685

(58) Field of Classification Search ..... 212/276, 212/230, 271, 264, 231, 280, 299; 340/685
See application file for complete search history.

(56) References Cited

U.S. PATENT DOCUMENTS

| | | | | |
|---|---|---|---|---|
| 4,679,653 | A * | 7/1987 | Pasquarette et al. | 182/2.4 |
| 5,877,693 | A * | 3/1999 | Eyler | 340/685 |
| 2002/0190845 | A1 * | 12/2002 | Moore | 340/10.3 |
| 2005/0258122 | A1 | 11/2005 | Morath | 212/294 |
| 2006/0259270 | A1 * | 11/2006 | Shimomura | 702/173 |
| 2007/0010295 | A1 * | 1/2007 | Greene et al. | 455/572 |

FOREIGN PATENT DOCUMENTS

| | | | |
|---|---|---|---|
| DE | 36 06 590 | A1 * | 9/1987 |
| DE | 10001215 | | 10/2000 |
| JP | 2005-089044 | A * | 4/2005 |
| WO | WO-9806349 | | 4/1992 |
| WO | 98/55388 | A * | 12/1998 |

* cited by examiner

*Primary Examiner* — Michael Mansen
*Assistant Examiner* — Juan Campos, Jr.
(74) *Attorney, Agent, or Firm* — Andrew Wilford

(57) ABSTRACT

Mobile or stationary working apparatus, in particular a working vehicle, with at least one telescopic extension arm (3) which has two or more extension arm elements (31, 32, 33) which can be moved in relation to one another, with detection means being provided on the extension arm elements (31, 32, 33) and also on a base station, in particular a rotatable trailer of the working vehicle, for detecting the position of the extension arm elements (31, 32, 33) in relation to one another and with respect to the base station, with provision being made, according to the invention, for the detection means to be in the form of radio detection means, with a radio base unit (8) being arranged on the base station and further transponder units (10, 12) being arranged on the extension arm elements (32, 33).

5 Claims, 1 Drawing Sheet

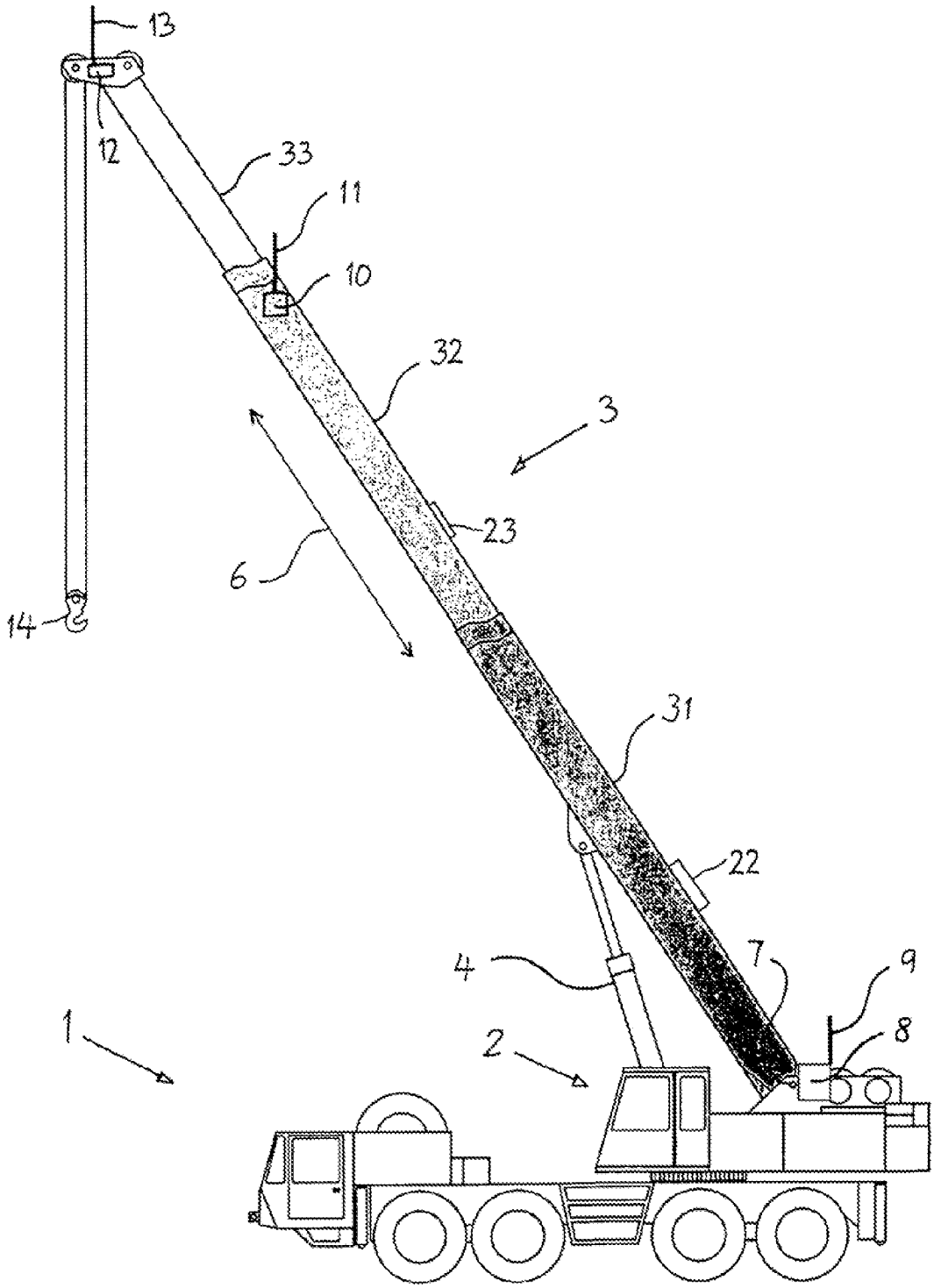
13
12
33
11
10
32
3
23
6
14
31
22
4
7
9
8
1
2

MOBILE OR STATIONARY WORKING APPARATUS WITH TELESCOPIC EXTENSION ARM ELEMENTS WHOSE POSITION IN RELATION TO ONE ANOTHER IS DETECTED BY RFID TECHNOLOGY

CROSS REFERENCE TO RELATED APPLICATIONS

This application is the US national stage of PCT application PCT/DE2007/000890, filed 2 Feb. 2007, published 6 Dec. 2007 as WO2007/137634, and claiming the priority of German patent application 102006025002.8 itself filed 30 May 2006, whose entire disclosures are herewith incorporated by reference.

FIELD OF THE INVENTION

The invention relates to mobile or stationary equipment, especially a construction vehicle, with at least one telescoping arm comprising two or more telescoping parts that can move relative to each other, with detectors provided on the telescoping parts as is well as on a base for detecting the position of the telescoping parts relative to each other and relative to the base.

STATE OF THE ART

In mobile equipment, e.g. in automotive cranes, it is known that a first extension arm part is mounted on a rotatable semitrailer, can pivot vertically, and is constructed so that it can rotate together with the semitrailer. One or more further telescoping parts can extend longitudinally from the first arm part so that the entire extension arm of the piece of equipment can be telescoped. This design is basically known and serves on the one hand for achieving the required height or extension in order to be able to reach more remote points and, for example, to be able to operate with loads. If the telescoping arm is collapsed, it has the advantage that it requires only a small amount of space, which is necessary in particular in the case of mobile construction vehicles such as automotive cranes, for traveling on streets.

It is necessary for telescoping, that is the drawing in or out of the individual telescoping parts between their end positions, to know the particular position of each extension arm part relative to another extension arm part or relative to the base. To this end a mechanically acting detector is already known requiring, starting from the base, in particular from the rotatable semitrailer, a cable that is unwound as the parts telescope apart, during which movement the length of the rolled-out cable line is measured to determine the extent of telescoping. The rolling in or out of the cable line is detected via a potentiometer. This is mechanically acting system has the basic advantages that the telescoping can be effectively detected with it and that it is robustly constructed. However, it has the disadvantage that it is subjected to frictional wear, contamination and the like, so that it is prone to error. It this is to be avoided, a monitoring and cleaning and/or readjustment of the mechanically acting detector is necessary, which is also disadvantageous. Moreover, the space necessary for accommodating the cable rollers, cable and detector as well as the potentiometer clearly increases with increasing length of the individual telescoping parts, so that this space must be made available and makes it impossible to make the elements of the equipment compact. Furthermore, in the case of large telescope lengths, that is, a plurality of telescoping parts, sagging of the cable (due to its own weight) results in undesired measuring errors.

In addition, it has already been suggested in order to eliminate the susceptibility to errors that an optically acting detector be used. In this case, starting from the base, a light beam is projected to mirrors on the telescoping parts for reflection and reception back at the base. The position of the telescoping parts relative to each other and relative to the base can then be determined from the difference in delay time. However, this optically acting detector has the decisive disadvantage that it on the one hand is very susceptible to dirt, so that the light beam can no longer be completely reflected or not reflected at all if the mirror on the extension arm part is contaminated, which is very frequently the case with construction equipment. On the other hand, there is the disadvantage in equipment that something can block the light beam between the sending unit and mirror, so that the determination of position relative to one another is to longer possible. Moreover, there is basically the problem in telescoping arms that they sag, at first because of their own weight when completely extended, which sagging process is amplified even more in the case of a suspended load. As a result, there is also the danger that the transmitted light beam no longer completely reaches the mirror or does not reach it at all, or in order to avoid this effect extremely comprehensive and complex compensation designs must be used that are also disadvantageous.

OBJECT OF THE INVENTION

The invention therefore has the object of providing a system for the detection of the positions of several telescoping parts relative to each other and relative to a base that avoids the initially described disadvantages.

SUMMARY OF THE INVENTION

The invention provides that the detector is designed as a radio detection means comprising a radio base unit on the base of the equipment and further transponders on the telescoping parts. The design of the detector as radio detection means has the basic advantage that it is compact, is subjected to no mechanical wear, and contamination or other adverse influences on the radio detection means do not adversely affect its operation. The radio detection means has the particular advantage that its operation is also not adversely influenced by contamination or by sagging of the telescoping arm with or without a load. Since the radio detection means consists of a radio base unit and further transponders that are designed to operate independently, the latter can be mounted in a rapid and simple manner and replaced just as rapidly in case of a defect.

A further development of the invention provides that the radio detection means are designed as RFID units. This has the advantage that the detector is extremely economical and robust. The basic mode of operation of RFID units is apparent, for example, from *RFID Handbuch* (bound edition, 418 pages, Hanser Fachbuchverlag, publication date: October 2002, 3d edition, updated and expanded edition, ISBN: 3446220712), chapter 3 (in particular pages 29 to 61), which disclosure is expressly incorporated in the disclosure of this patent application. An RFID unit according to such a design is described in it in particular in chapter 3.2.1, which construction and method of operation may be but do not have to be used in this equipment. It is essential for the invention that correspondingly designed and operating RFID units are used in equipment for measuring of length and for data exchange returning the measured length.

BRIEF DESCRIPTION OF THE DRAWING

The invention is described in the following using an illustrated embodiment to which the invention is, however, not limited and is explained using the single FIGURE.

EMBODIMENTS OF THE INVENTION

The drawing shows, in as far as shown in detail, a crane with 1 as piece of mobile equipment that comprises in a known manner a rotatable semitrailer 2 as well as a telescoping arm 3 with several telescoping parts 31, 32, and 33. The first extension arm part 31 carried directly on the rotatable semitrailer 2 is pivoted up by a hydraulic unit 4. Starting from the first extension arm part 31, middle and outer telescoping parts 32 and 33 can be telescoped in a longitudinal direction 6, that is, they are designed to be pushed into or extended out of one another. The entire telescoping arm 3 can be pivoted up by the hydraulic unit 4 about a pivot axis 7 on the rotatable semitrailer 2 and be telescoped via means not further shown. Since the invention relates to the determination of the position of the individual telescoping parts 31 to 33 relative to each other and relative to the rotatable semitrailer 2, a description of the rest of the construction of crane vehicle 1 is not necessary, so that in the following the radio detection means for the determination of position in accordance with the invention will be discussed.

To this end a radio base unit 8 with an antenna 9 is mounted on the rotatable semitrailer 2 (or on some other location of the crane vehicle 1). The radio base unit 8 can have its own power supply (such as, e.g., battery or accumulator) or it can be powered from the crane vehicle 1. The radio base unit 8 communicates via radio with a transponder 10 having an antenna 11 on the middle extension arm part 32 as well as with a further transponder 12 that also has an antenna 13 on the outer extension arm part 33. The first extension arm part 31 does not require an independent transponder since it cannot change its position in the longitudinal direction 6 relative to the rotatable semitrailer 2. It is mentioned at this point that the radio base unit 8 can also be mounted at any desired location, in particular on the outer end of the first extension arm part 31. It is especially advantageous if the radio base unit 8 as well as the middle and outer transponders 10, 12 are mounted at the greatest possible distance from each other when the telescoping arm 3 is completely extended in order to minimize tolerance errors in the determining of position. To this end the middle transponder 10 is mounted on the outer end of middle telescoping arm part 32 and the outer transponder 10 on the outer end of the outer arm part 33. This results, when the middle and outer telescoping parts 31 to 33 are completely extended, in the greatest possible distance between the transponders 10 and 12 from each other as well as relative to the radio base unit 8 so that tolerance errors can be minimized.

In order to be able to detect the particular position of the individual telescoping parts 32 and 33 relative to the first extension arm part 31 and to the rotatable semitrailer 2, the radio base unit 8 sends high-frequency signals to the antennas 10 and 13 of the transponders 10 and 12 via its antenna 9 that are received and sent back, optionally after processing. The returned signals can then be received again by the antenna 9 of the radio base unit 8 and recorded in it, during which operation the position of the extension arm part 32 and 33 can be determined from the delay time difference between the sent signal and the received signal. The design of the radio detection means has the advantage that contamination, sagging and the like have no influence on the sending and receiving of the high-frequency signals and determination of positions is possible at any time. The measured delay differences can also be displayed so the operator of the crane vehicle 1 sees the position of the individual telescoping parts of telescoping arm 3 on a control panel in the rotatable semitrailer 2. If this display takes place graphically, the operator can operate the means controlling the retraction or extension of the middle and outer telescoping parts 32 and 33 in a sure manner in order to be able to adjust certain desired positions or states of the telescoping arm 3. Thus, it is conceivable, for example, that in the case of a large load suspended from a hook 14, the outer extension arm part 33 is not extended at all but the middle extension arm part 32 is completely extended. The retraction and extension of the individual telescoping parts 31 to 33 in the longitudinal direction 6 as well as around the pivot axis 7 are a function of the local conditions as well as of the suspended load. The structure of the radio detection means in RFID technology has the further advantage that one knows at all times how far an individual extension arm part 32 or 33 is retracted or extended since the radio base unit 8 can transmit high-frequency signals designed in a coded manner for each individual transponder 10, or can receive and further process the high-frequency signals sent back from the transponders 10 and 12. The invention makes it possible for the first time to retract and extend individual telescoping parts 32 and 33 independently of each other in a controlled manner so long as the actuators 22 and 23 for the telescoping parts 32 and 33 are also designed to move the individual extension arm part 32, 33 independently of each other.

According to a further embodiment of the invention, the radio base unit 8 and/or one or several transponders 10 and 12 are designed for data transmission with other radio base units and/or other transponders, especially those of further mobile or stationary working devices. As a supplement or alternative to the radio base unit 8 mounted on rotatable semitrailer 2, a mobile radio base unit acting outside of crane vehicle 1 can be used that is designed as a remote control or remote detector. It is furthermore possible to increase redundancy with a further radio base unit. To this end more than one transponder 10 and 12 can also be provided on each extension arm part 32 and 33, which is advantageous if a transponder is destroyed by external mechanical influences. As regards the radio base unit, it is conceivable that in addition to the radio base unit 8 permanently mounted on rotatable semitrailer 2 another radio base unit is mounted in a remote control for the crane vehicle 1 so that operation of the rotatable semitrailer 2 can be done remotely and controlled with its telescoping arm 3 in a wired or wireless manner.

The invention claimed is:

1. A mobile or stationary crane comprising:

a base;

an arm having a first part pivoted on the base about a horizontal axis, a middle part telescoping longitudinally on the first part, and an outer part telescoping longitudinally on the middle part;

respective independently operable outer and middle actuator means coupled to the outer and middle parts for independently longitudinally shifting same relative to each other and to the first part;

respective middle and outer RFID units on outer ends of the middle and outer parts; and control means on the base or first part for transmitting radio signal to and receiving radio signals from the middle and outer RFID units for determining a distance between the outer ends of the middle and outer parts from the base or first part and for independently operating the actuator means in accordance with the determined respective distances.

2. The crane defined in claim 1 wherein the control means is mounted on the base adjacent the axis.

3. The crane defined in claim 1 wherein the base is part of a semitrailer of an automotive vehicle.

4. The crane defined in claim 3 wherein the base is pivotal on the semitrailer about a vertical axis.

5. The crane defined in claim 1 wherein the RFID units are supplied electrical power via radio.

* * * * *